United States Patent [19]

Patriarca

[11] Patent Number: 4,738,094

[45] Date of Patent: Apr. 19, 1988

[54] ROVING STOPPING CLAMP, IN PARTICULAR FOR SPINNING MACHINES

[75] Inventor: Giovanni Patriarca, Como, Italy

[73] Assignee: Sampre Societa Meccanica Precisione S.p.A., Milan, Italy

[21] Appl. No.: 46,490

[22] Filed: May 6, 1987

[30] Foreign Application Priority Data

May 22, 1986 [IT] Italy ..... 2194486[U]

[51] Int. Cl.[4] ..... D01H 13/16; D01H 13/18

[52] U.S. Cl. ..... 57/87; 57/81; 57/84; 57/86

[58] Field of Search ..... 57/80, 81, 84–87

[56] References Cited

U.S. PATENT DOCUMENTS

| | | | |
|---|---|---|---|
| 1,305,540 | 6/1919 | Hanscom et al. | 57/87 |
| 1,395,223 | 10/1921 | Conyngham | 57/86 |
| 1,397,283 | 11/1921 | Hartman | 57/86 |

*Primary Examiner*—John Petrakes

*Attorney, Agent, or Firm*—Neuman, Williams, Anderson & Olson

[57] ABSTRACT

A clamp is disclosed to be mounted on a yarn spinning machine and, if a roving of the yarn should break, serves to clamp the roving preventing it from further unravelling. The clamp comprises a housing body including a member for defining a passage guide for the roving and a blocking element mounted by the housing body to be moved by a biasing spring from a detained position to a roving clamping position. A sensor is provided to sense the breakage of the roving for actuating an electromagnet for releasing a lever that normally engages and holds the blocking member in its retained position, whereby the blocking element is moved by the spring to it's clamping position to thereby retain and clamp the roving against the member. A guide channel is attached to the housing body and further supports a fastening mechanism for mounting the clamp to the spinning machine.

7 Claims, 1 Drawing Sheet

ROVING STOPPING CLAMP, IN PARTICULAR FOR SPINNING MACHINES

The object of the present invention is to provide a new and improved roving stopping clamp, in particular for spinning machines.

Clamps are known for stopping the roving in spinning machines when a yarn breakage occurs to prevent material waste, and the possibility that fibers may be wound-up on the draft cylinders or on other elements of the spinning machine.

The clamps of the prior art on one hand do not allow an easy introduction of the roving, and on the other hand can cause the accidental escape of the roving from its preestablished routes, due to the oscillations that the roving undergoes during its unwinding from the bobbin, to the effect of the travelling blowers and suction cleaning devices as are provided normally on the spinning machines, or because of accidental actions undertaken by the operator.

An object of the present invention is to overcome the above cited disadvantages and, furthermore, to provide a clamp capable of being adjustably positioned as a function of the different lengths of the draft field.

In view of this and other objects of the invention, there is provided a clamp, particularly for a spinning machine, comprising a housing body for blocking means, connected with a yarn breakage sensor means, and by a guide channel provided under the housing body. The blocking means comprises an electromagnet housed within the housing body, and operatively connected with a toothed, elastically swinging lever, which engages a shaped blocking element to clamp the roving, by means of a toothed portion of the blocking element. A lower portion of the blocking element is hinged onto a portion of the housing body at a position adjacent to the electromagnet. A spring is provided suitable to urge the blocking element away from the electromagnet and towards a shaped end member acting as a stop for the blocking element and as a guide for the roving. The shaped body extends from the housing body. The guide channel, provided under the housing body supports the fastening means, adjustable in height, and suitable to attach the clamp 10 to the spinning machine.

Figure 1:
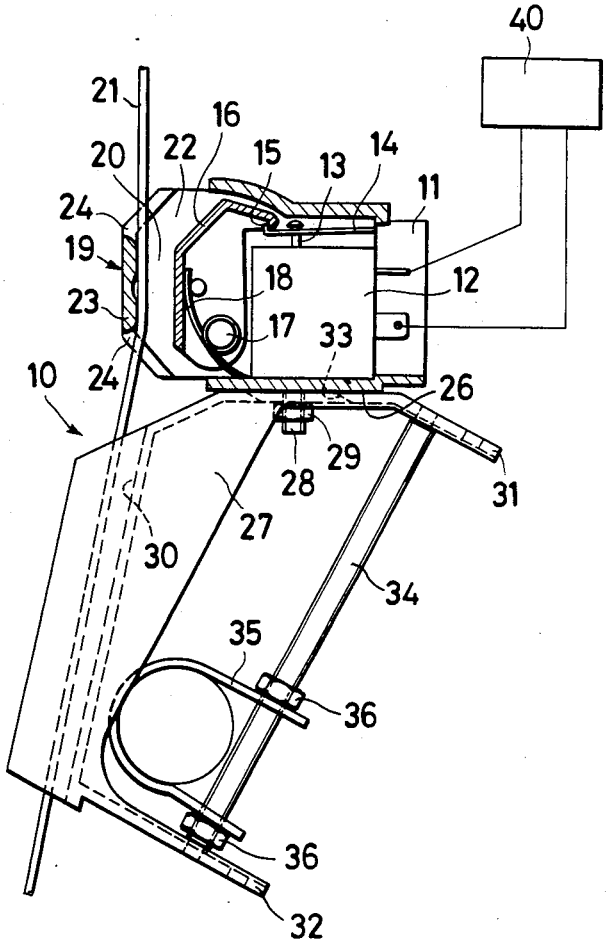
Figure 2:
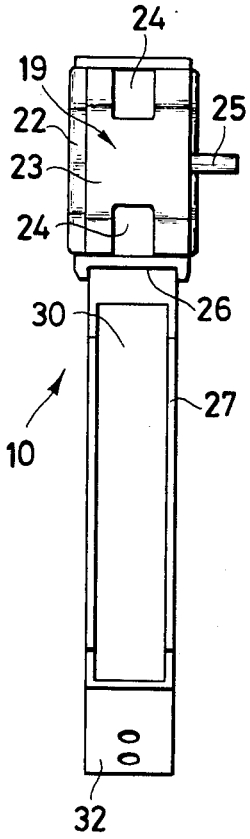

The present invention is now disclosed with reference to the figures of the attached drawings, wherein:

FIG. 1 is a partial, sectional side view of a clamp according to the invention, and FIG. 2 is a front view of the clamp of FIG. 1.

Referring to the figures, a clamp 10 according to the invention comprises a housing body 11 inside which an electromagnet 12 is provided, and from which a pin 13 protrudes upwards. The pin is attached to a moving element (not shown) and to a pivoting lever 14 provided atop the electromagnet 12 and attached at one of its ends to the housing body 11. The lever 14 is provided, at its free end, with an upwards-extending tooth 15.

In front of the electromagnet, a shaped blocking element 16 is provided. The element 16 is hinged about a pivot 17 affixed to the housing body 11 and is equipped with a compressed spring 18, which urges the blocking element 16 away from the electromagnet 12 and towards an end member 19.

The element 16 is furthermore so shaped that it can come into engagement with the tooth 15 of the lever 14, and is laterally provided with a stud 25 for resetting the clamp 10.

The end member 19 extends from the housing body 11 in front of the blocking element 16 defining a guide passage 20 for a roving generally indicated by the numeral 21.

The end member 19 comprises a side wall 22 frontally connected with an essentially "C"-shaped element 23 and is provided with slots 24 on the top side and on the bottom side thereof.

The housing body 11 is provided at its bottom portion with a track 26 inside which a guide channel 27 for the roving 21 is adjustably attached in various positions by means of a bolt 28 protruding from the body 11 and is held thereto by a nut 29.

As an alternative, the housing body 11 and the guide channel 27 may be provided as one single piece, or they may be engaged by means of a connection not allowing relative movement between the body 11 and the channel 27.

The guide channel 27 is constituted by a "C"-shaped race 30 and of upper and lower portions from which brackets 31 and 32 respectively extend.

The bracket 31 is provided with a slot 33 for receiving therethrough the bolt 28. A threaded rod 34 is provided between and is attached at its ends to the brackets 31 and 32, respectively.

On the threaded rod 34 an adjustable support 35 is provided, to enable the clamp 10 to be fastened onto a spinning machine (not shown). The support 35 is affixed to the threaded rod 34 by a pair of nuts 36 disposed on either side thereof.

Advantageously, the clamp 10 according to the present invention allows an easy introduction of the roving 21 inside the guide passage 20 defined by the blocking element 16 and by the the end member 19, and at the same time, prevents the accidental escape of the roving 21 due to the effect of oscillations thereof and/or of the action of the blowers.

A further advantage of the present invention results from the positioning of the guide channel 27 underneath the housing body 11 to protect the roving 21 from the air stream delivered by the blowers and to prevent the roving 21 from being possibly undone and its fibers from being dispersed.

When a clamp 10 according to the present invention is assembled on a spinning machine, its position is adjusted by means of the adjustable support 35 and/or by means of the adjustment of the guide channel 27 (the adjustment of the guide channel may be not provided in those cases in which, as already noted, the body 11 and the channel 27 are made up of a single piece, or are so connected that no relative movement therebetween is allowed).

The roving 21, inserted inside the guide passage 20, is clamped, in case of breakage, by the blocking element 16. The electromagnet 12 is actuated to withdraw the lever 14 from the blocking element 16, whereby it is released and urged by the spring 18 into a clamping relation with the roving 21. Obviously, the enabling of the electromagnet 12 is controlled by a special sensor (schematically indicated by numeral 40), suitable to detect the breakage of the yarn or roving 21.

The present invention has been disclosed with regard to an illustrative embodiment, and changes may be readily made to it by those skilled in the art, within the protective scope of the attached claims.

What is claimed is :

1. A clamp to be mounted on a machine spinning yarn and, if a roving of the yarn should break, operative to clamp the roving, said clamp comprising:

(a) a housing body including a member forming openings for defining a guide for the passage of the roving therethrough along a path adjacent said member;

(b) a biasing spring;

(c) a blocking element supported by said housing body for movement by said biasing spring from a detained position to a clamping position;

(d) a lever for engaging and holding said blocking element in its detained position;

(e) an electromagnet supported by said housing body and actuable to move said lever, whereby said lever releases said blocking element;

(f) sensor means disposed to sense the breakage of the roving for actuating said electromagnet, whereby said lever releases said blocking element and is moved by said spring to its clamping position, wherein said blocking element disposes the roving from said path and against said member, thereby preventing further unraveling of the roving;

(g) a guide channel attached to said housing body to extend below and defining a race through which the roving is directed; and (h) fastening means attached to said guide channel for mounting said clamp upon its spinning machine.

2. The clamp as claimed in claim 1, wherein said lever has at one end thereof a tooth and said blocking element is configured to be engaged by said tooth, whereby said blocking element is held in its detained position.

3. The clamp as claimed in claim 1, wherein said member extends laterally from said housing body and is configured in a "C" shape and defines at the ends of said "C" shaped member said openings for defining said passage guide.

4. The clamp as claimed in claim 1, wherein said member and said blocking element when held in its detained position define said guide passage.

5. The clamp as claimed in claim 1, wherein said guide channel further comprises first and second brackets extending respectively from an upper and lower portion thereof, said fastening means being positioned between said pair of brackets.

6. The clamp as claimed in claim 5, wherein said first bracket is provided with a slot for receiving a bolt supported upon said housing body, whereby said housing body and said guide channel are held together.

7. The clamp as claimed in claim 5, wherein said fastening means comprises a threaded rod, a support adapted to be attached to the spinning machine and means for adjustably fastening said support to said threaded rod at a variable position there along, whereby the position of said clamp may be adjusted with respect to the spinning machine.

* * * * *